US009702656B2

(12) United States Patent
Vyprachticky

(10) Patent No.: US 9,702,656 B2
(45) Date of Patent: Jul. 11, 2017

(54) PIVOTAL HANDLE FOR ARCHERY BOW

(71) Applicant: Emil Vyprachticky, Arvada, CO (US)

(72) Inventor: Emil Vyprachticky, Arvada, CO (US)

( * ) Notice: Subject to any disclaimer, the term of this patent is extended or adjusted under 35 U.S.C. 154(b) by 187 days.

(21) Appl. No.: 14/164,525

(22) Filed: Jan. 27, 2014

(65) Prior Publication Data

US 2015/0211824 A1 Jul. 30, 2015

(51) Int. Cl.
*F41B 5/14* (2006.01)

(52) U.S. Cl.
CPC ..... *F41B 5/1403* (2013.01)

(58) Field of Classification Search
CPC ..... F41B 5/00
USPC ..... 124/23.1
See application file for complete search history.

(56) References Cited

U.S. PATENT DOCUMENTS 5,081,979 A * 1/1992 Burling ..... 124/23.1
5,243,958 A * 9/1993 Shepley, Jr. ..... 124/88
5,842,460 A * 12/1998 Barber ..... 124/88

* cited by examiner

*Primary Examiner* — Gene Kim
*Assistant Examiner* — Jeffrey Vanderveen
(74) *Attorney, Agent, or Firm* — Hanes & Bartels LLC

(57) ABSTRACT

The present invention is a self-aligning archery bow that has upper and lower risers and a grip intermediate the risers. A U-shaped handle overlying the grip is pivotally attached to the grip whereby the handle pivots about vertical axes in response to torque on the bow produced by force on the draw string, thus compensating for the tendency of the bow and the grip to twist in the hand of the archer. The pivotal movement of the handle is accommodated through a plurality of ball bearings that operatively engage the grip and the handle, and a pivotal bolt that connects the handle to the grip.

13 Claims, 7 Drawing Sheets

PIVOTAL HANDLE FOR ARCHERY BOW

This application is a continuation-in-part of application Ser. No. 13/722,299, filed Dec. 20, 2012.

FIELD OF THE INVENTION

The present invention relates to archery bows and more specifically to a pivotal handle that attaches to the bow grip that is integral with and intermediate of the bow risers.

BACKGROUND OF THE INVENTION

Especially in bows of higher draw strength, drawing the string of the bow produces torque in the bow risers with a resulting tendency for the bow grip to twist in the hand of the archer. When the arrow is released the sudden release of the torque on the bow forces the grip to twist in the opposite direction causing deflection of the arrow path or oscillation of the arrow, both of which affect the accuracy of the shot. Although thicker grip sections are desirable from the comfort standpoint, such thicker sections act to increase hand contact and amplify the adverse consequences of torque on the bow grip. To eliminate the results of this amplified torque problem, the conventional wisdom has been to make the grip section of the riser narrow and thin, thus reducing the degree of hand contact with the bow. While this solution may reduce the effects of bow torque, thin grips are uncomfortable and more difficult to grasp securely and consistently. Accordingly, one object of the present invention is to provide a thicker and more comfortable archery bow handle, but at the same time reduce the adverse effects of torque on the bow by eliminating any twisting or rotation of the handle in the archer's hand. This eliminates accuracy problems created by inconsistent grips and gloved hands.

The problem created by bow torque has been recognized in U.S. Pat. No. 6,988,495 for Bow Grip Assembly. This patent disclosure represents one effort to solve the problem. The '495 patent provides a pivotal handgrip that is mounted to the bow by an intermediate device that is snap fitted onto the bow over a bearing assembly that is attached to the bow riser. While the bow grip of the '495 patent achieves its stated objectives, the needle bearings that are a basic element of the bearing assembly can not tolerate the forces created in high draw strength bows.

Accordingly, it is further object of the present invention to provide a handle for an archery bow that is pivotal with respect to the bow grip and relies exclusively on high strength ball bearings to support the pivotal function between the bow grip and the handle in high draw strength bows.

SUMMARY OF THE INVENTION

The archery bow of the present invention comprises a generally U shaped handle that overlies and is pivotally coupled to the bow grip that is integrally disposed between the upper and lower bow risers. In operation, the handle is held in a fixed position with respect to the archer's hand. Twisting forces on the bow that are produced by the draw string cause the integral bow grip to pivot within the handle. The U shaped handle is adapted to overlay, in spaced apart relation, the sides of the integral bow grip while the base of the U shaped handle is pivotal connected to the rear surface of the bow grip. To accommodate the mounting of the U shaped handle of the present invention, the traditional bow grip is modified to include at least two hemispherical sockets disposed on vertically spaced apart vertically oriented mounting platforms on the rear surface of the grip. Hardened spherical ball bearings are disposed in each of the hemispherical sockets. The interior rear surface of the U shaped handle contains similar spaced apart hemispherical sockets adapted to seat the respective spherical balls that are disposed in the bow grip sockets. A fastening bolt that interconnects the handle and the grip is configured to provide a pivotal interconnection between the bow grip and the U shaped handle, thus allowing the handle to pivot about at least two vertical axes on the respective at least two spherical bearings. Thus, instead of the traditional grip twisting in the hand of the shooter, the U shaped handle remains stationary with respect to the hand of the archer while the bow pivots or rotates within the handle in response to the force applied to the draw string.

DETAILED DESCRIPTION OF PREFERRED EMBODIMENT

Figure 1:
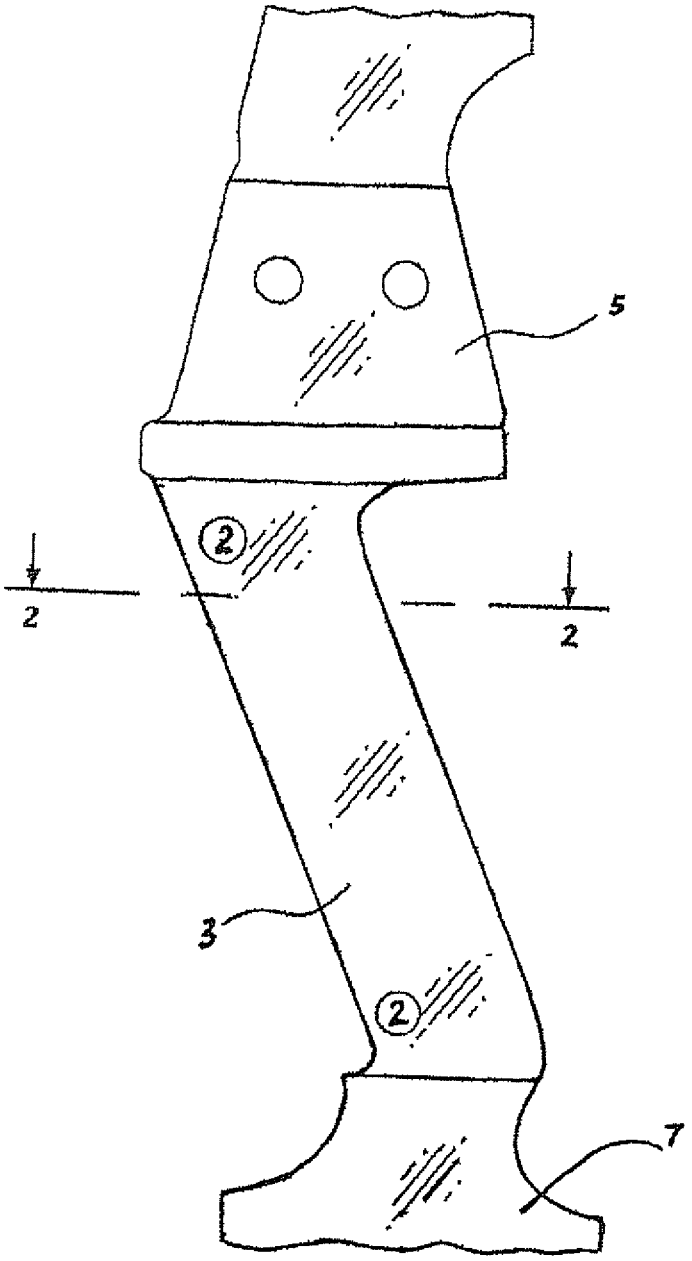
FIG. 1 is a fragmentary side view of a typical bow grip that is integral with the upper and lower bow risers.
Figure 2:
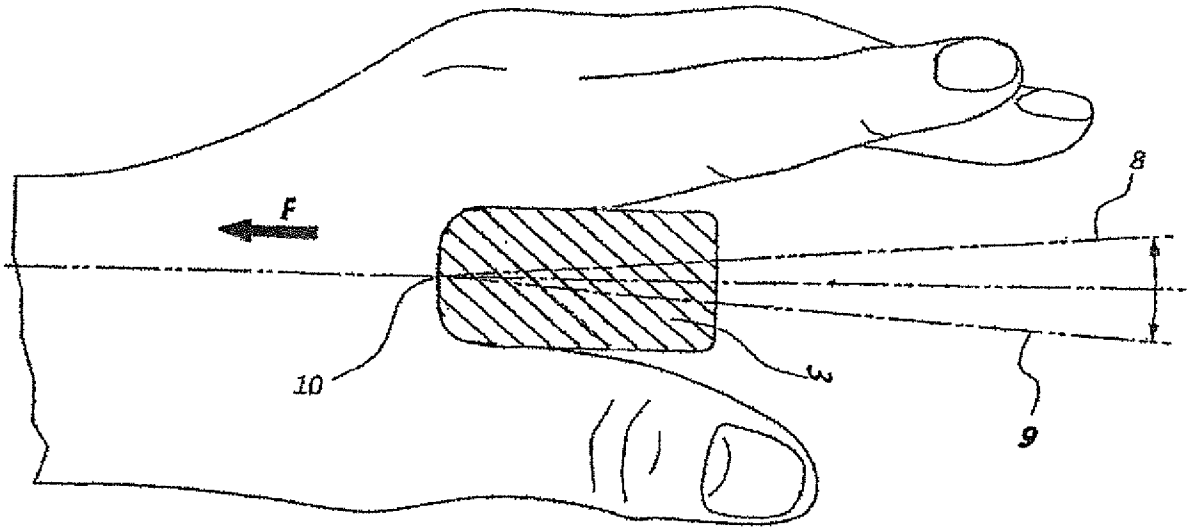
FIG. 2 is a cross sectional view of the bow grip of FIG. 1, taken along lines 2-2 of FIG. 1, and showing the hand of an archer grasping the bow grip. Dashed lines illustrate the direction of twisting of the grip in the hand of the archer that is caused by torque on the bow that is created by draw string force.

The grip section 3 of a typical archery bow is shown in FIG. 1 as being integrally disposed between the upper and lower bow risers 5 and 7. Felt pads 2 cushion contact between the grip 3 and the handle 12 and reduce any possible noise from the contact between the sides of the handle and the bow grip. A cross sectional view of the grip is shown in FIG. 2 as it would appear in the hand of an archer. Dotted lines 8 and 9 emanating at angles from the center of the rotation 10 illustrate the possible angular twist of the grip 3 that is produced by draw string torque on the bow.

Figure 3:
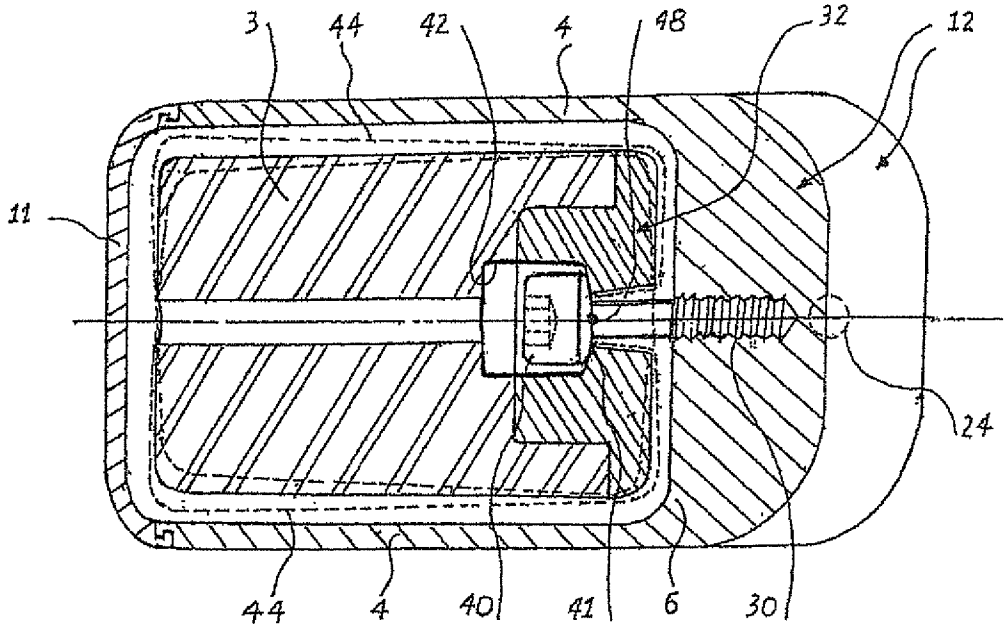
FIG. 3 is a cross sectional view of the archery bow of the present invention, taken along lines 3-3 of FIG. 5. The dotted lines depict the extreme positions of the bow grip as it pivots within the handle.
Figure 6:
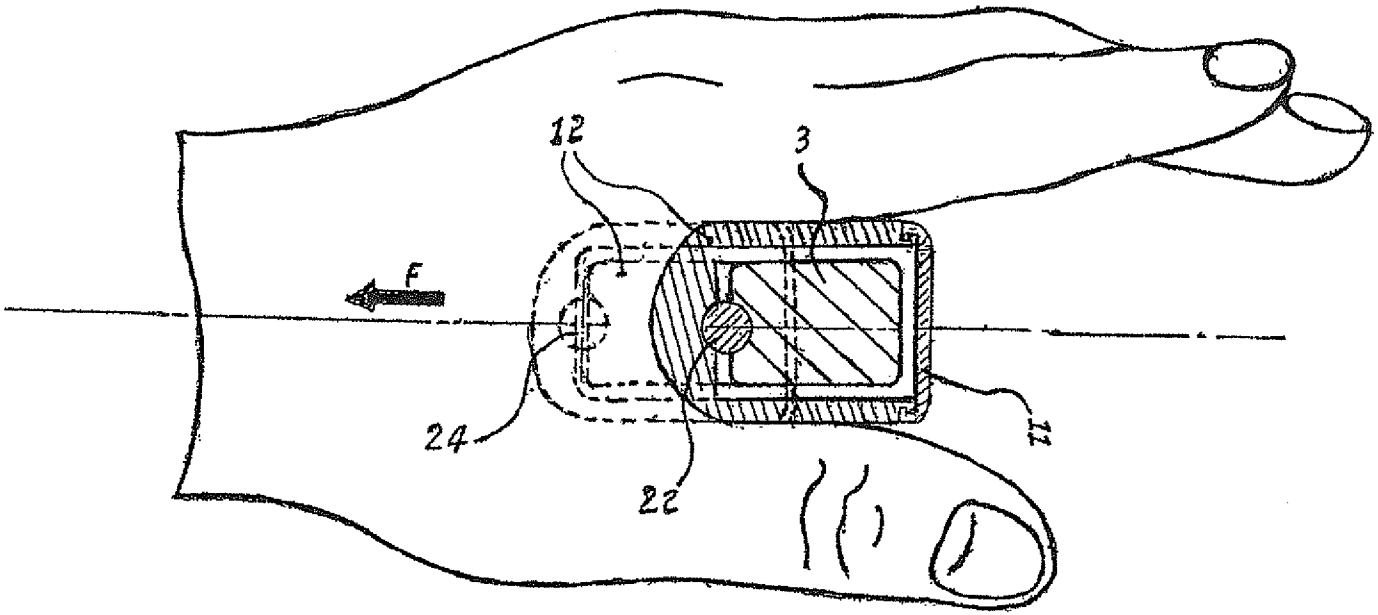
FIG. 6 is a cross sectional view taken along lines 6-6 of FIG. 5 showing the hand of an archer grasping the pivotal handle and where the bow grip is in a neutral position with no draw string force applied.

A U-shaped pivotal handle 12 having lateral sides 4 and a base 6 is illustrated in. FIGS. 3 and 6 in its position enclosing a modified bow grip 3. A removable cover plate 11 completes the enclosure of the bow grip and perfects the handle 12.

Figure 5:
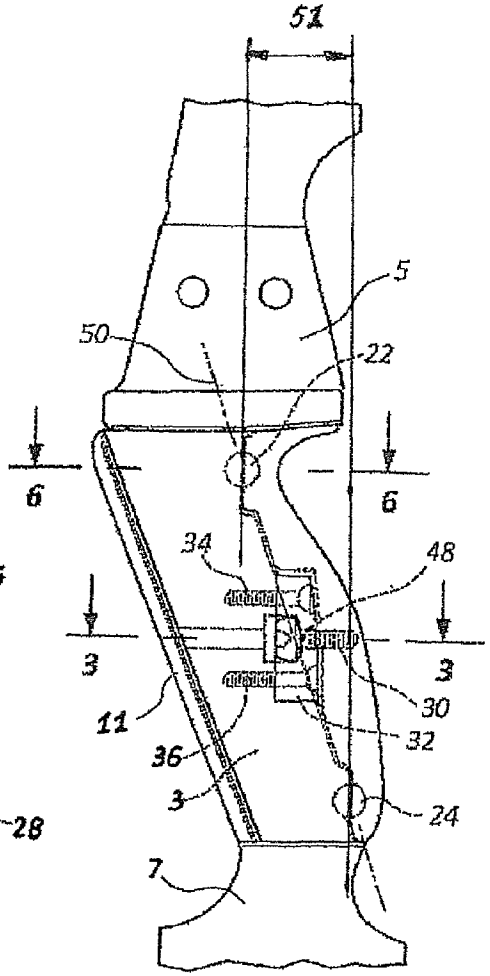
FIG. 5 is a side view of the pivotal handle of the present invention and showing the grip/handle interconnection fastener and supporting pivot bearings in dotted lines.
Figure 4:
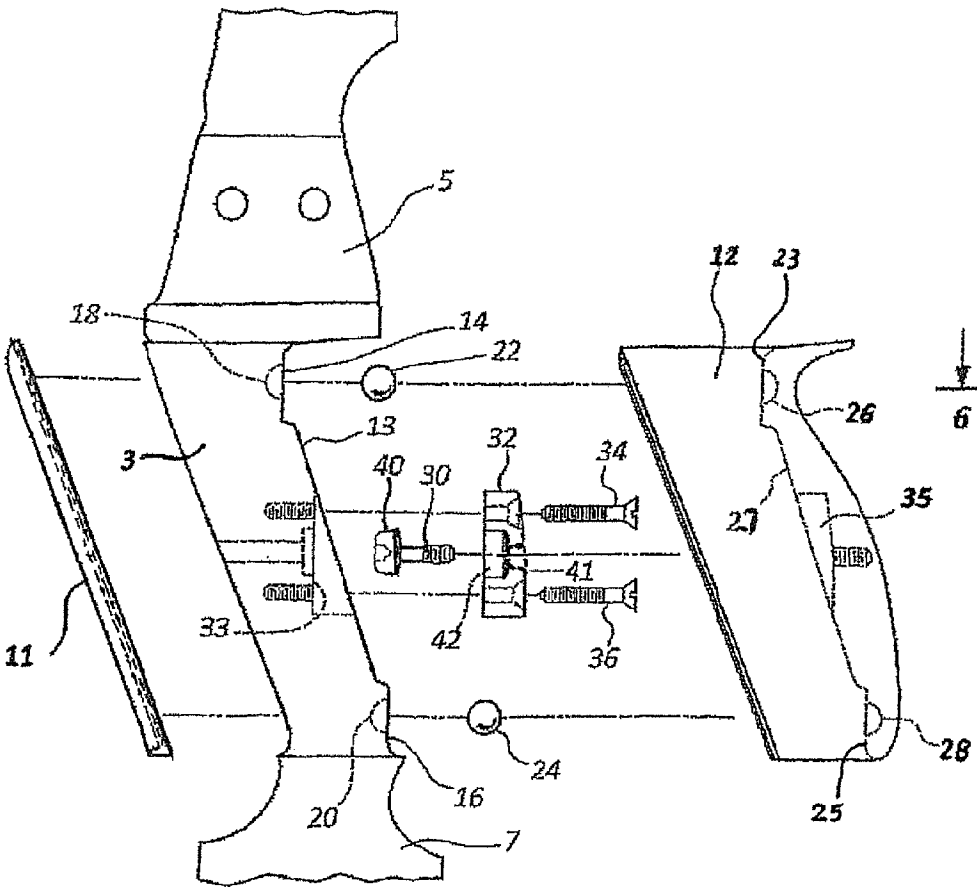
FIG. 4 is an exploded side view of the modified bow grip and the pivotal handle and showing the ball bearings and the bolt fastener that interconnects the bow grip and the handle of the present invention.

As shown in FIGS. 4 and 5, the modified bow grip 3 is provided on its flat rear surface 13 with vertically spaced apart upper and horizontally offset upper and lower vertically oriented platforms 14 and 16. Each of the platforms contains a hemispherical socket 18 and 20 that accommodates respective ball bearings 22 and 24. The rear interior surface 27 of the handle 12 is also provided with spaced apart vertically oriented flat platforms 23 and 25 that contain hemispherical ball bearing seats 26 and 28 that receive the respective bearings 22 and 24. Each of the bearings provide a double pivotal interconnection between the handle 12 and the bow grip 3.

The handle 12 is attached to the bow grip 3 by a socket head bolt 30 which is journaled in a mounting block 32 whose forward facing side is seated in a vertically oriented recess 33 in the rear facing surface 13 of the bow grip 3. The mounting block is connected to the grip 3 with screws 34 and 36. The rearward facing side of the mounting block 32 is disposed within a vertically oriented recess 35 in the inside rear surface 27 of the handle 12. The head 40 of the bolt 30 is disposed in an oversized countersunk recess 42 in the frontal side of the mounting block 32, as shown in FIGS. 3 and 4. The Threaded shank of the bolt 30 passes through an enlarged tapered bore 41 in the block 32 and threadingly engages the base 6 of the handle 12. The bolt 30 secures the handle 12 to the grip 3, while at the same time allowing relative pivotal movement on the bearings 22 and 24 between the bow grip 3 and the handle 12 in a plane perpendicular to the plane of the bow. Limitation of the pivotal movement is provided by the confines of the oversized countersunk recess 42 and the enlarged tapered bore 41 in the mounting block 32, as illustrated in FIG. 3. The dotted lines 44 in FIG. 3 illustrate the limits of pivotal rotation of the bow grip 3 within the handle 12.

The crucial problem to be overcome in retrofitting a traditional bow grip with the pivotal handle of the present invention is to create a hinge system on a sloping surface 13 that will allow the grip to pivot around a vertical axis. The problem is solved by the provision in the present invention of several significant features. First, the bearings 22 and 24 are seated in recesses 18 and 20 which are disposed in vertically oriented platforms 14 and 16 that match opposing vertical platforms 23 and 25 in the interior surface 27 of the pivotal handle 12. Second, there is a single point of pivotal connection between the bow grip 3 and the handle 12, that is, the bolt 30. Third, in order for the handle 12 to rotate about vertical axes and horizontally displaced hinge pivot points (bearings 22 and 24), the center point of the bearings must lie in a common plane which must also pass through the pivot point 48 of the bolt 30. The common plane is depicted by line 50 in FIG. 5. An added feature of the horizontally off set bearings 22 and 24 is the increased breadth that the spaced apart pivot points provide for the arrow rest. In prior-art bows it is necessary for accuracy that the arrow rest be located in the same vertical plane as the single pivot point in the bow grip. However, with two horizontally off set pivot points in the bow handle of the present invention (22 and 24) the arrow rest is broadened to that distance shown by reference numeral 51 in FIG. 5, that is, the horizontal distance between the vertical planes that intersect the respective centers of the bearings 22 and 24.

Figure 7:
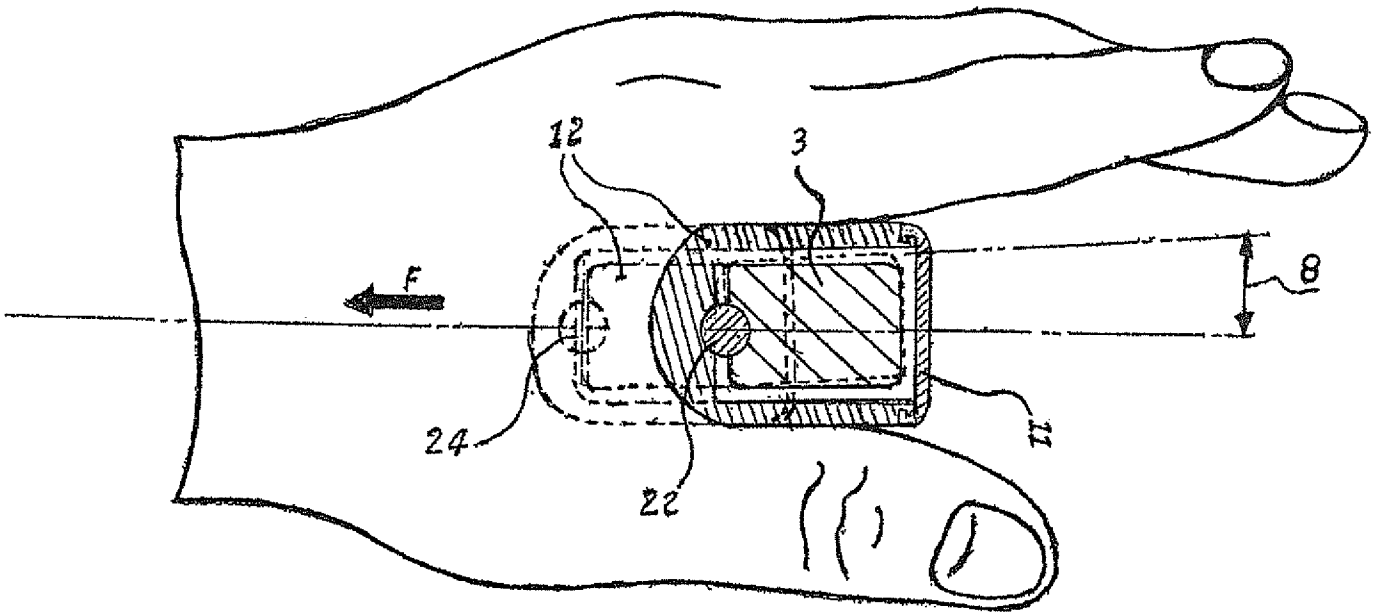
FIG. 7 is a cross sectional view taken along lines 6-6 of FIG. 5 illustrating the pivotal movement of the bow grip within the handle when draw string force is applied.

As shown in FIG. 7, the twisting force produced in the bow by pulling force on the draw string will rotate the bow grip 3 within the handle 12 to the extent of angle 8, while the handle does not twist or rotate within the hand of the shooter.

Figure 8:
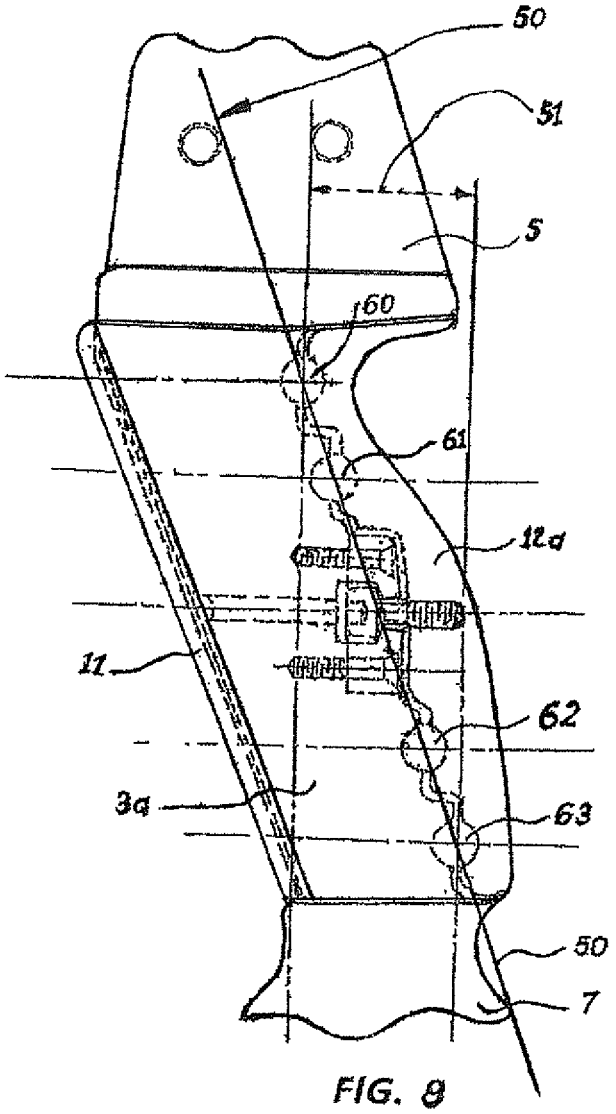
FIG. 8 is similar to the structure shown in FIG. 5 except that FIG. 8 illustrates a second embodiment of the invention having four pivot bearings in order to tolerate higher draw string strength bows.

FIG. 8 of the drawings illustrates a second embodiment of the invention intended for use with very high draw strength bows. The difference between the preferred form and the second embodiment is the increase in bearing surfaces. Bearings 60, 61, 62 and 63 are disposed in hemispherical recesses in separate spaced apart vertically oriented platforms on the grip 3*a* of the bow. Similar bearing recesses are provided in the inside surface of the modified handle 12*a*. The bow grip and handle are interconnected in the same manner as shown and described for the preferred embodiment. The common plane 50 passes through the center of all of the bearings and the center of rotation 48 of the attachment bolt 30.

What is claimed is:

1. A pivotable handle for an archery bow having upper and lower risers comprising, a grip integral with and disposed intermediate the upper and lower risers of the bow, where the grip includes, inclined front and rear surfaces and opposed lateral sides, at least two spaced apart and vertically oriented bearing mounting platforms formed on the rear surface of the bow grip, a hemispherical pocket disposed in each of the bearing mounting platforms, a plurality of spherical ball bearings, each having a center point and disposed respectively in each of the hemispherical pockets, a generally U-shaped handle enclosing the bow grip and overlying and being spaced apart from the lateral sides of the grip, said handle having an interior rear surface including at least two spaced apart and vertically oriented bearing mounting platforms each with a hemispherical pocket adapted to seat the respective ball bearings disposed in the bow grip pockets, pivotally movable fastening means for having a pivot point for interconnecting the handle to the bow grip where the fastening means pivots in a plane perpendicular to the plane of the bow grip and the upper and lower risers.

2. The pivotal handle of claim 1 where the fastening means includes a bolt having a truncated head and a threaded shaft.

3. The pivotal handle of claim 2 where the fastening means includes a Mounting block secured to the rear surface of the bow grip intermediate the spaced apart bearing mounting platforms, said mounting block having a countersunk bore and an adjacent tapered bore to embrace the head and shaft of the bolt.

4. The pivotal handle of claim 3 where the bolt threadingly engages the rear interior surface of the handle.

5. The pivotal handle of claim 4 where the bow grip includes a bore having a longitudinal axis aligned with the embraced bolt, said bore opening on the front surface of the bow grip.

6. The pivotal handle of claim 5 and further including a slidable cover interconnecting the lateral sides of the handle and positioned to cover the front surface of the bow grip.

7. The pivotal handle of claim 1 where the center points of the ball bearings and the pivot point of the fastening means lie in a common plane.

8. A self-aligning archery bow having upper and lower risers and comprising, a grip intermediate the risers and integral therewith, said grip having flat lateral sides and inclined front and rear surfaces, a U-shaped handle overlaying the rear surface of the grip and spaced apart from its lateral sides, a plurality of ball bearings, each having a center point, and each in rolling engagement with the handle and the inclined rear surface of the grip, and fastening means for pivotally interconnecting the handle to the grip where the fastening means includes a pivotal center point.

9. The archery bow of claim 8 where the ball bearings are vertically spaced apart and horizontally off set from one another.

10. The archery bow of claim 9 where the center points of the ball bearings and the pivotal center point of the fastening means lie in a common plane.

11. The archery bow of claim 10 where the fastening means includes a mounting block carried by the rear surface of the grip and a bolt pivotally disposed in the mounting block and secured into the handle.

12. An archery bow having upper and lower risers and including, a grip intermediate the risers and integral therewith, said grip having lateral sides and a rear surface, a U-shaped handle having a base and lateral sides overlaying and spaced apart from the lateral sides of the grip, a plurality of ball bearings each in rolling engagement with the rear surface of the grip and the base of the U-shaped handle and, fastening means for pivotally interconnecting the handle and the grip.

13. The archery bow of claim 12 where the ball bearings each have a center point and the means interconnecting the handle and the grip has a pivotal center point and where the said pivotal center point and the center points of the plurality of ball bearings lie in a common plane.

* * * * *